US007041013B2

(12) United States Patent
Ohama et al.

(10) Patent No.: US 7,041,013 B2
(45) Date of Patent: May 9, 2006

(54) GOLF BALL

(75) Inventors: Keiji Ohama, Kobe (JP); Takahiro Sajima, Kobe (JP)

(73) Assignee: SRI Sports Limited, Kobe (JP)

( * ) Notice: Subject to any disclaimer, the term of this patent is extended or adjusted under 35 U.S.C. 154(b) by 0 days.

(21) Appl. No.: 10/817,919

(22) Filed: Apr. 6, 2004

(65) Prior Publication Data

US 2004/0198536 A1 Oct. 7, 2004

(30) Foreign Application Priority Data

Apr. 7, 2003 (JP) ..... 2003-103233

(51) Int. Cl.
*A63B 37/12* (2006.01)

(52) U.S. Cl. ..... 473/384

(58) Field of Classification Search ..... 473/378–385
See application file for complete search history.

(56) References Cited

U.S. PATENT DOCUMENTS 4,813,677 A 3/1989 Oka et al.
5,733,205 A * 3/1998 Higuchi et al. ..... 473/376
5,735,757 A 4/1998 Moriyama
5,795,247 A * 8/1998 Yokota et al. ..... 473/374
5,800,287 A * 9/1998 Yokota et al. ..... 473/372
6,494,794 B1 * 12/2002 Ohama ..... 473/371
6,599,204 B1 * 7/2003 Kasashima et al. ..... 473/383
6,656,059 B1 * 12/2003 Umezawa et al. ..... 473/373

FOREIGN PATENT DOCUMENTS

JP 2-68077 A 3/1990

* cited by examiner

*Primary Examiner*—Raeann Gorden
(74) *Attorney, Agent, or Firm*—Birch, Stewart, Kolasch & Birch, LLP

(57) ABSTRACT

Golf ball 1 has numerous dimples 4 on its surface. The dimple 4 comprises an inclined face 6, a circular flat face 7, an annular groove 8 and a round flat face 9. Surface area s1 is calculated by summing up the surface area of the inclined face 6, the surface area of the circular flat face 7, the surface area of the annular groove 8 and the surface area of the round flat face 9. The ratio (S1/S2) between a summation S1 of surface areas s1 of all the dimples, and a summation S2 of the areas s2 of the regions cut away by the dimples on the phantom spherical face is equal to or greater than 1.02. Total value (Cb+Cc) of the amount of compressive deformation Cb of the golf ball 1 and the amount of compressive deformation Cc of the core is equal to or greater than 7.0 mm.

9 Claims, 7 Drawing Sheets

GOLF BALL

This application claims priority on Patent Application No. 2003-103233 filed in Japan on Apr. 7, 2003.

BACKGROUND OF THE INVENTION

1. Field of the Invention

The present invention relates to golf balls. More particularly, the present invention relates to golf balls having a core and a cover, with dimples being formed on the cover.

2. Description of the Related Art

General golf balls that are commercially available in the market have a core and a cover. The core is composed of a solid rubber, and the cover is composed of a resin composition. There also exist cores composed of two or more layers, as well as covers composed of two or more layers.

There are numerous dimples formed on the surface the cover. A role of the dimples involves causing turbulent flow separation through disrupting the air flow around the golf ball during the flight (hereinafter, referred to as "dimple effect"). By causing the turbulent flow separation, a separating point of air from the golf ball shifts backwards leading to the reduction of a drag coefficient (Cd). The turbulent flow separation promotes the differentia between upper and lower separating points of the golf ball that result from the backspin, thereby enhancing the lift force that acts upon the golf ball. Flight distance of the golf ball is prolonged on behalf of the reduced drag and enhanced lift force. Aerodynamically excellent dimples promote the turbulent flow separation. In other words, aerodynamically excellent dimples may render the air flow better.

During the flight of a golf ball, the air flows along the dimples. Shape of the dimple is one of the important factors that determine the aerodynamic characteristics of the golf ball. In an attempt to improve the dimple effect, a variety of proposals have been made in connection with a cross sectional shape of the dimple. JP-A No. 2-68077 discloses dimples having a protrusion at the center. U.S. Pat. No. 5,735,757 discloses dimples having two curved faces. The curvatures of the faces are different from each other.

Volume of the dimples is also one of the important factors that determine aerodynamic characteristics of the golf ball. U.S. Pat. No. 4,813,677 discloses a golf ball having an index of the dimple volume within a predetermined range.

What are most demanded for a golf ball by golf players are flight performances. In particular, golf players with less power desire golf balls that are excellent in flight performances. There is still left room for improvement of dimples in light of the flight performance. An object of the present invention is to provide a golf ball that achieves a great flight distance upon hitting by even a golf player with less power.

SUMMARY OF THE INVENTION

The golf ball according to the present invention has a core, a cover and numerous dimples formed on the surface of this cover. According to this golf ball, the ratio (S1/S2) between a summation S1 of surface areas s1 of the dimples, and a summation S2 of the areas s2 of the regions cut away by the dimples on the phantom spherical face is equal to or greater than 1.02. Total value (Cb+Cc) of the amount of compressive deformation Cb of this golf ball and the amount of compressive deformation Cc of the core is equal to or greater than 7.0 mm.

This golf ball has a greater ratio (S1/S2) in comparison with conventional golf balls. According to this golf ball, the drag is reduced. This golf ball has a great total value (Cb+Cc). In other words, this golf ball is liable to be deformed. According to an easily deformable golf ball, a great launch angle is provided. This golf ball provides an optimal trajectory on behalf of a synergistic effect of small drag and great launch angle. This golf ball is excellent in the flight performance.

In light of the availability of a great launch angle, the amount of compressive deformation Cb of the golf ball is preferably equal to or greater than 3.4 mm, whilst the amount of compressive deformation Cc of the core is equal to or greater than 4.0 mm. In light of the flight performance, it is preferred that total volume V of the dimples is 400 $mm^3$ or greater and 800 $mm^3$ or less.

The dimple preferably has a recessed part at the center thereof. The dimple may have an annular groove. The recessed part and the annular groove is responsible for the balance of the ratio (S1/S2) that is equal to or greater than 1.02 and optimum total volume V.

BRIEF DESCRIPTION OF THE DRAWINGS

FIG. 4(*b*) is a cross-sectional view of the golf ball shown in FIG. 4(*a*);

FIG. 5(*b*) is a cross-sectional view of the golf ball shown in FIG. 5(*a*);

FIG. 6(*b*) is a cross-sectional view of the golf ball shown in FIG. 6(*a*)

DESCRIPTION OF THE PREFERRED EMBODIMENTS

The present invention is hereinafter described in detail with appropriate references to the accompanying drawing according to the preferred embodiments of the present invention.

Figure 1:
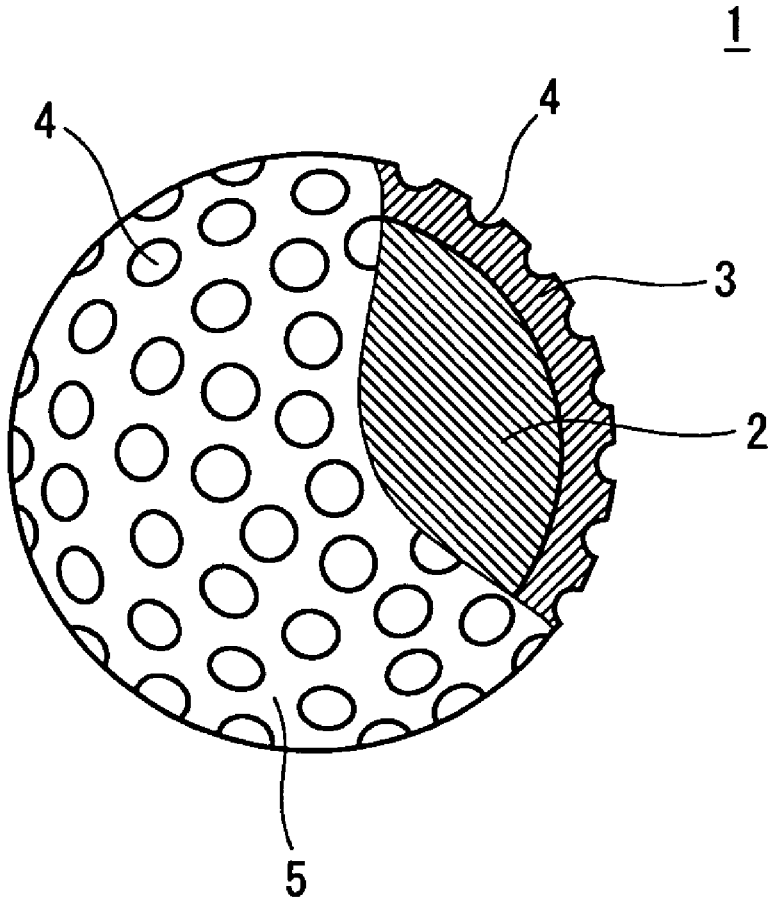
FIG. 1 is a schematic cross-sectional view illustrating a golf ball according to one embodiment of the present invention.

A golf ball 1 depicted in FIG. 1 has a spherical core 2 and a cover 3. Numerous dimples 4 are formed on the surface of the cover 3. Of the surface of the cover 3, parts other than the dimples 4 are lands 5. This golf ball 1 has a paint layer and a mark layer to the external side of the cover 3, although these layers are not shown in the Figure. This golf ball 1 has a diameter of from 40 mm to 45 mm in general, and in particular, of from 42 mm to 44 mm. In light of the reduction of the air resistance in the range to comply with a rule defined by United States Golf Association (USGA), the diameter is particularly preferably 42.67 mm or greater and 42.85 mm or less. Weight of this golf ball 1 is generally 40 g or greater and 50 g or less, and particularly 44 g or greater and 47 g or less. In light of the elevation of inertia in the range to comply with a rule defined by USGA, the weight is particularly preferably 45.00 g or greater and 45.93 g or less.

Figure 2:
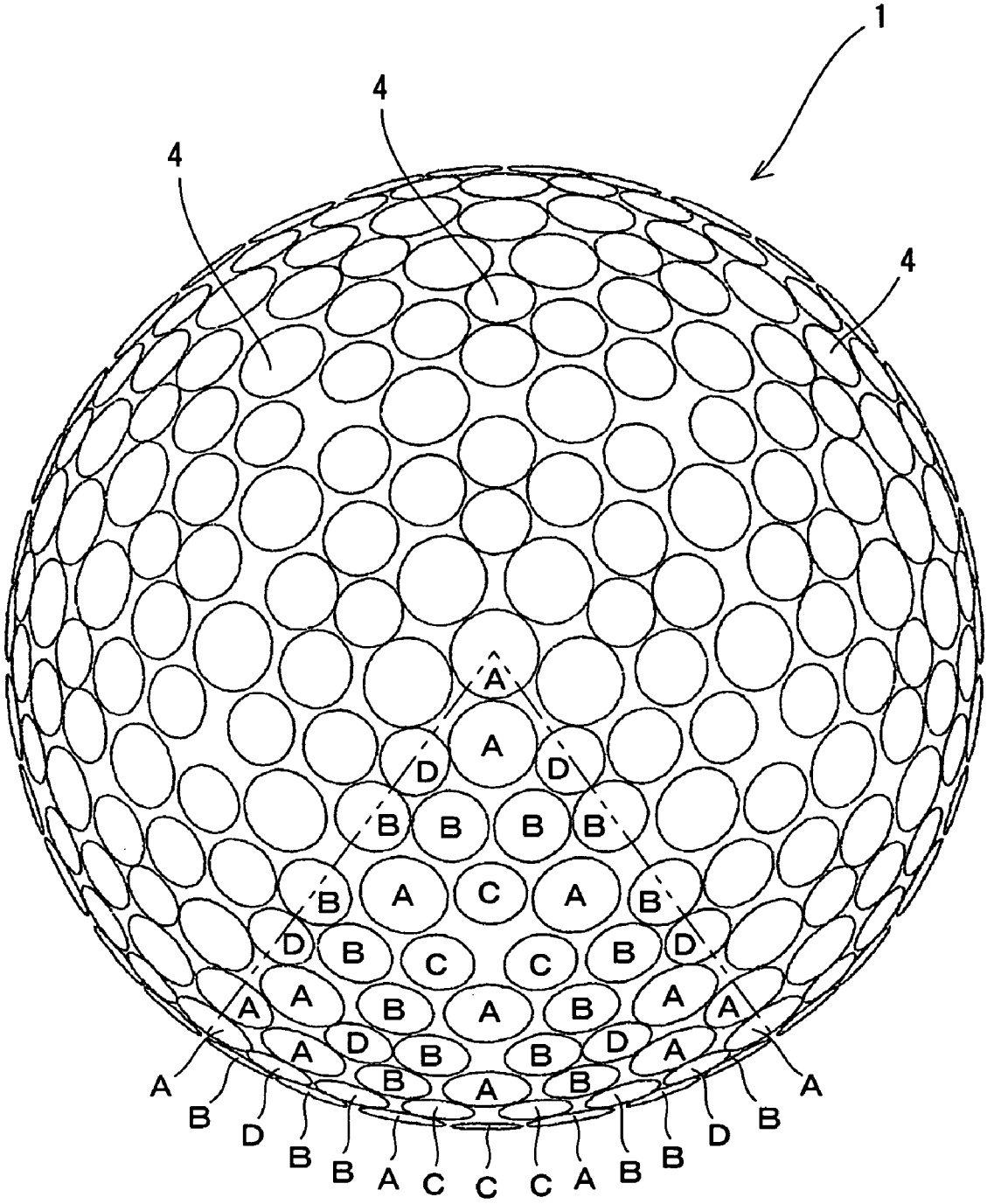
FIG. 2 is an enlarged plan view illustrating the golf ball shown in FIG. 1.
Figure 3:
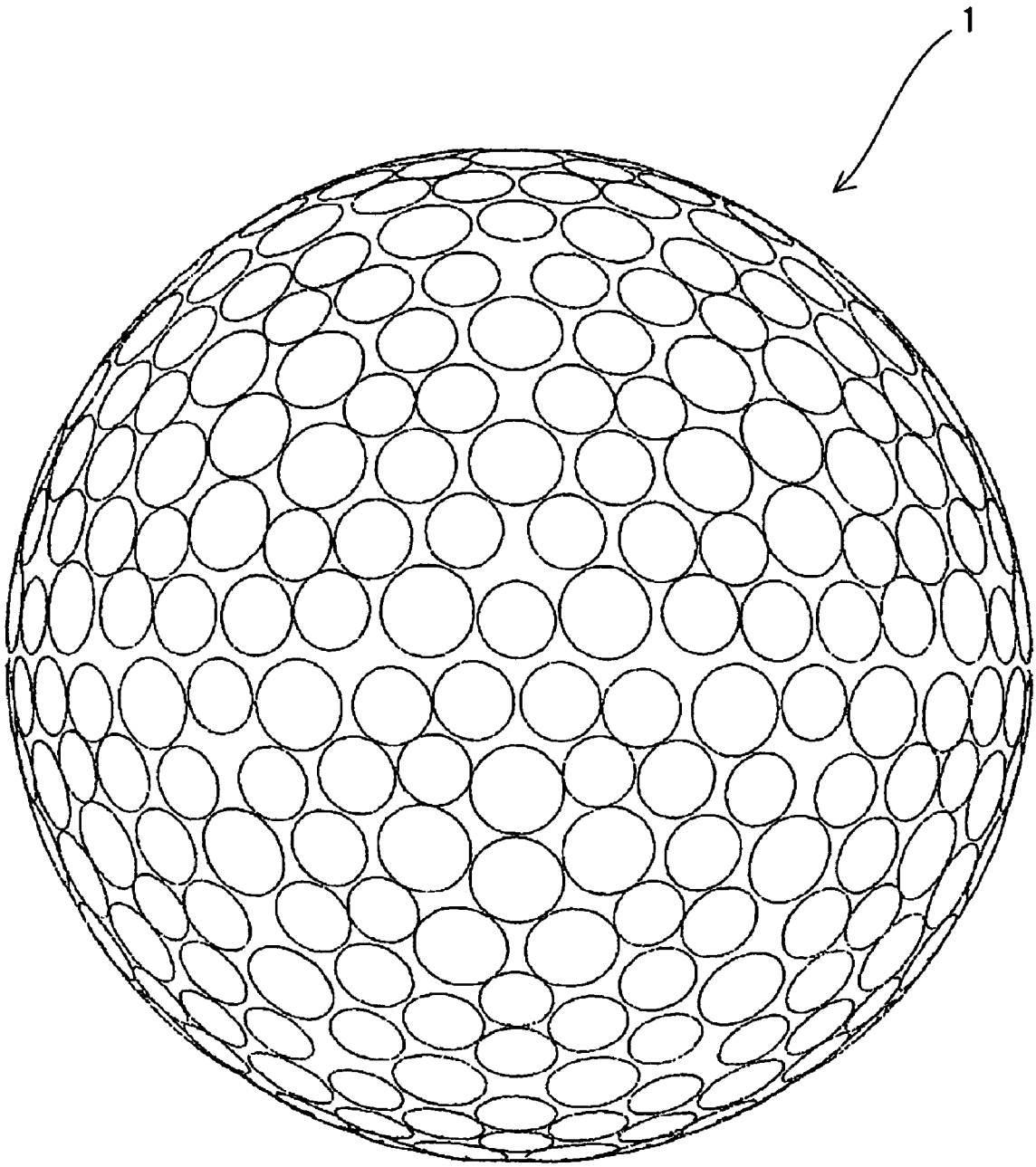
FIG. 3 is a front view illustrating the golf ball shown in FIG. 2.

FIG. 2 is an enlarged plan view illustrating the golf ball 1 shown in FIG. 1; and FIG. 3 is a front view of the same. This golf ball 1 has A dimples having a plane shape of circular with the diameter of 4.00 mm, B dimples having a plane shape of circular with the diameter of 3.45 mm, C dimples having a plane shape of circular with the diameter of 3.30 mm, and D dimples having a plane shape of circular with the diameter of 3.15 mm. The term "plane shape" referred to herein means the shape of the contour line which is a boundary between the land 5 and the dimple 4, when it is viewed at infinity. The number of the A dimples is 132; the number of the B dimples is 180; the number of the C dimples is 60; and the number of the D dimples is 60. Total number N of dimples of this golf ball 1 is 432. In FIG. 2, four types of the dimples 4 are illustrated by reference symbols A to D with respect to one unit given by comparting the surface of the golf ball 1 into 10 equivalent units.

Figure 4:
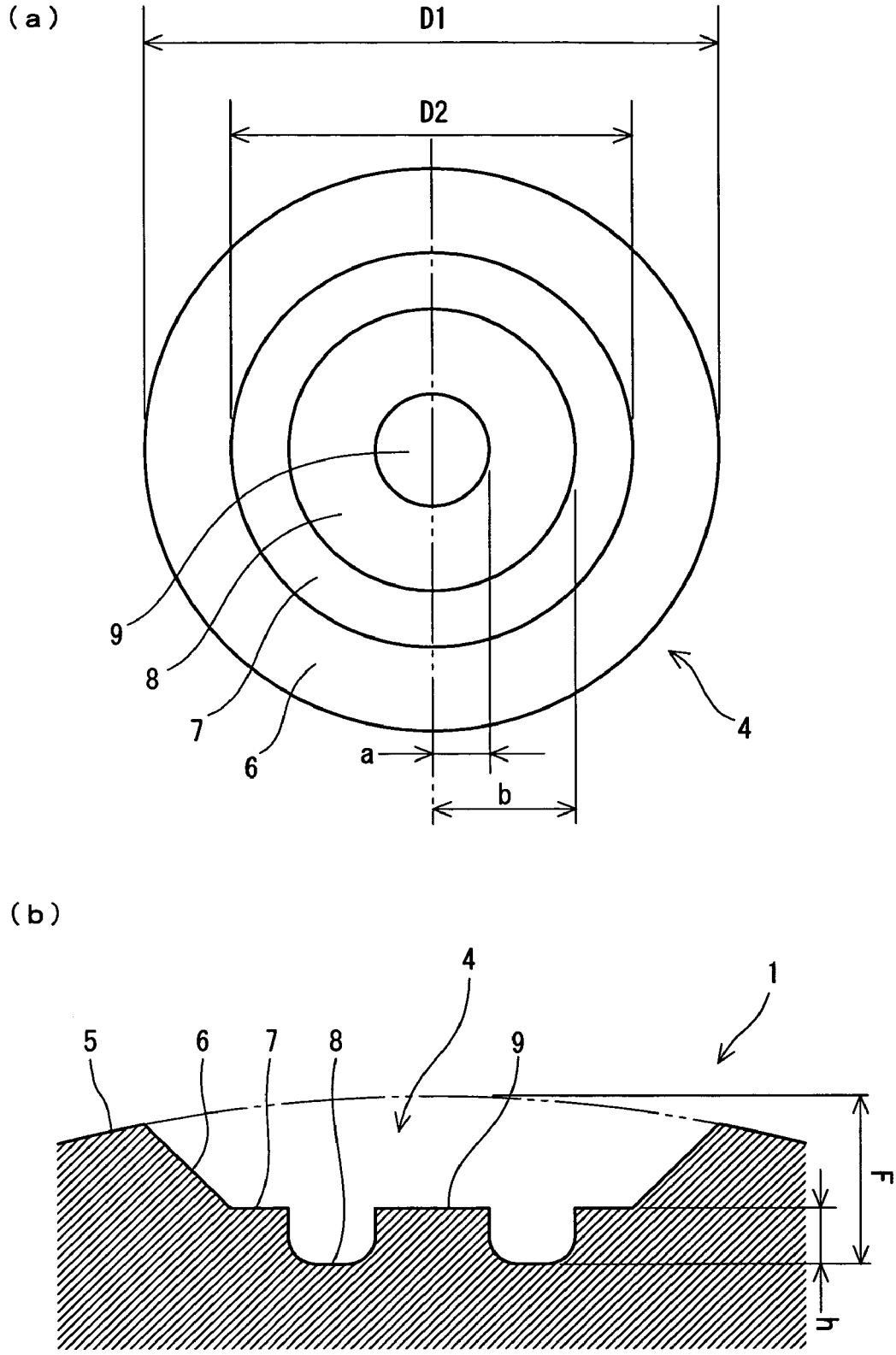
FIG. 4(*a*) is an enlarged view illustrating a part of the golf ball shown in FIG. 1.

FIG. 4(*a*) is an enlarged view illustrating a part of the golf ball 1 shown in FIG. 1; and FIG. 4(*b*) is a cross-sectional view derived from FIG. 4(*a*). In this FIG. 4(*b*), a cross-section is illustrated which is provided by a plane that passes the center of gravity of the plane shape of the dimple 4 and the center of the golf ball 1. As shown in this FIG. 4, the dimple 4 comprises an inclined face 6, a circular flat face 7, an annular groove 8 and a round flat face 9. The surface area s1 is calculated by summing up the surface area of the inclined face 6, the surface area of the circular flat face 7, the surface area of the annular groove 8 and the surface area of the round flat face 9. The surface area S1 is obtained by summing up the surface areas s1 of all the dimples. As is clear from FIG. 4(*b*), the cross-sectional shape of the annular groove 8 is "U" shaped. The dimple 4 may have an annular groove of which cross-sectional shape being "V" shaped, half round, circular arc or the like.

What is depicted by a chain double-dashed line in FIG. 4(*b*) is a region that was cut away by the dimple 4 on the phantom spherical face. The area of this region is s2. Area S2 is obtained by summing up the areas s2 for all the dimples. The phantom spherical face means a spherical face which may be present when it is postulated that there is no dimple 4 existed.

According to this dimple 4, the surface area s1 is increased on behalf of the annular groove 8. During the flight of the golf ball 1, the air flows along the dimples 4. It is speculated that the dimple 4 having a greater surface area s1 disturbs the air flow more efficiently. By providing a large number of dimples 4 having a great surface area s1, drag of the golf ball 1 can be reduced. By providing a large number of dimples 4 having a great surface area s1, the ratio (S1/S2) is increased. In other words, the ratio (S1/S2) is an index that correlates to the drag. The golf ball 1 having the ratio (S1/S2) of equal to or greater than 1.02 is excellent in the flight performance. The ratio (S1/S2) is more preferably equal to or greater than 1.05, and particularly preferably equal to or greater than 1.08. The ratio (S1/S2) is preferably equal to or less than 1.50. When the ratio (S1/S2) is too great, an expensive mold is required, and also, the formation of the paint layer becomes difficult.

By providing a large number of dimples 4 having the ratio (s1/s2) of equal to or greater than 1.02, a golf ball 1 having the ratio (S1/S2) of equal to or greater than 1.02 can be obtained. Proportion of the number of dimples 4, which have the ratio (s1/s2) of equal to or greater than 1.02, occupied in total dimple number N preferably accounts for equal to or greater than 50%, more preferably equal to or greater than 65%, and particularly preferably equal to or greater than 80%. This proportion is ideally 100%.

It is preferred that the surface area s1 is 8.2 $mm^2$ or greater and 37.8 $mm^2$ or less. It is preferred that total surface area S1 is 4090 $mm^2$ or greater and 7740 $mm^2$ or less. The surface area s2 is usually 8.0 $mm^2$ or greater and 25.8 $mm^2$ or less. Total surface area S2 is usually 4010 $mm^2$ or greater and 5160 $mm^2$ or less.

The "total volume V" referred to herein means a summation of the volume v of all the dimples. The "volume v of the dimple" herein means the volume of a space surrounded by a phantom spherical surface and the dimple 4. The total volume V in the present invention is set to be 400 $mm^3$ or greater and 800 $mm^3$ or less. When the total volume V is less than the above range, a hopping trajectory may be provided. In this respect, the total volume V is more preferably equal to or greater than 420 $mm^3$, and particularly preferably equal to or greater than 440 $mm^3$. When the total volume V is beyond the above range, a dropping trajectory may be provided. In this respect, the total volume V is more preferably equal to or less than 760 $mm^3$, and particularly preferably equal to or less than 720 $mm^3$. Through the formation of a large number of dimples 4 having an annular groove 8, the golf ball 1 can be obtained having the total volume V within a proper range, and with the ratio (S1/S2) being equal to or greater than 1.02.

What is shown by a both-sided arrowhead D1 in FIG. 4 is the diameter of the dimple 4. This diameter D1 is a distance between both contact points when common tangent lines are depicted at both sides of the dimple 4. What is formed from many contact points that are successively joined is a contour line. The diameter is set to be 2.0 mm or greater and 7.0 mm or less, in general, and particularly 2.5 mm or greater and 6.0 mm or less.

In stead of the circular dimples 4, or together with the circular dimples 4, non-circular dimples may be also formed. Specific examples of the non-circular dimple include elliptical dimples, oval dimples, egg-shaped dimples and polygonal dimples. When a non-circular dimple is formed, the contour length x of the same is usually set to be 6 mm or greater and 25 mm or less, and particularly, set to be 9 mm or greater and 22 mm or less. It is preferred that multiple kinds or types of dimples having the different shape or size with each other are formed.

It is preferred that the highest part of the dimple 4 does not protrude out of the phantom spherical face. Release of the air flowed into the dimple 4 is thereby suppressed. Ideally, the highest part of the dimple 4 is positioned on the contour line.

Surface area occupation ratio Y of the golf ball 1 is preferably 70% or greater and 90% or less. When the surface area occupation ratio Y is less than the above range, the dimple effect may be insufficient. In this respect, the surface area occupation ratio Y is more preferably equal to or greater than 72%, and particularly preferably equal to or greater than 75%. When the surface area occupation ratio Y is beyond than the above range, the land parts 5 are easily scuffed. In this respect, the surface area occupation ratio Y is more preferably equal to or less than 88%, and particularly preferably equal to or less than 87%. The term "surface area occupation ratio Y" referred to herein means a proportion of the total area S2 occupied in the surface area of the phantom spherical face.

What is shown by a both-sided arrowhead F in FIG. 4 is the depth of the dimple 4. This depth F is a distance between the deepest part in the dimple 4 and the phantom spherical face. The depth F is preferably 0.10 mm or greater and 2.00 mm or less. When the depth F is less than the above range, a hopping trajectory may be provided. In this respect, the depth F is more preferably equal to or greater than 0.12 mm, and particularly preferably equal to or greater than 0.14 mm. When the depth F is beyond the above range, a dropping trajectory may be provided In this respect, the depth F is more preferably equal to or less than 1.95 mm, and particularly preferably equal to or less than 1.90 mm.

Total number N of the dimples 4 is preferably 200 or greater and 500 or less. When the total number N is less than the above range, there is a possibility that the fundamental feature of the golf ball which is a substantially spherical body may not be sustained. In this respect, the total number N is more preferably equal to or greater than 230, and particularly preferably equal to or greater than 250. When the total number N is beyond than the above range, a drag coefficient (Cd) may become so large that the flight distance may become insufficient. In this respect, the total number N is more preferably equal to or less than 470, and particularly preferably equal to or less than 450.

Dimple specifications such as surface area s1, area s2, volume v, diameter D1, depth F and the like are determined by actual measurement of the golf ball 1. The golf ball 1 generally has a paint layer on its surface, and thus accurate measurement of the size may involve difficulties owing to the influences of this paint layer. When the actual measurement of the golf ball 1 having a paint layer involves difficulties, the golf ball prior to the painting may be subjected to the actual measurement.

Total value (Cb+Cc) of the amount of compressive deformation Cb of this golf ball 1 and the amount of compressive deformation Cc of the core 2 is equal to or greater than 7.0 mm. This golf ball 1 is liable to be deformed. Easily deformable golf ball 1 results in a great launch angle. According to the findings obtained by the present inventors, the golf ball 1 having the ratio (S1/S2) of equal to or greater than 1.02 exhibits sufficiently reduced drag, however, the insufficient lift force is provided. A great launch angle can be achieved by setting the total value (Cb+Cc) to be equal to or greater than 7.0 mm. Thus increased launch angle compensates for the insufficient lift force, thereby optimizing the trajectory. When a golf player with less power hits a conventional golf ball 1, insufficient flight distance is tend to be achieved because high trajectory is not provided owing to the weakness. The golf ball 1 according to the present invention is suited for golf players with less power. In light of the launch angle, the total value (Cb+Cc) is more preferably equal to or greater than 7.5 mm, and particularly preferably equal to or greater than 8.0 mm. When the total value (Cb+Cc) is too large, the resilience performance of the golf ball 1 may become insufficient. In this respect, the total value (Cb+Cc) is more preferably equal to or less than 13.0 mm, and particularly preferably equal to or less than 12.0 mm.

Upon the measurement of the amount of compressive deformation, a spherical body which is a subject to be measured is first placed on a hard plate made of metal. Next, a cylinder made of metal is rendered to descend gradually toward the spherical body. Accordingly, the spherical body, which is intervened between the bottom face of this cylinder and the hard plate, is deformed. A migration distance of the cylinder, starting from the state in which an initial load of 98 N is applied to the spherical body up to the state in which a final load of 1274 N is applied thereto, is the amount of compressive deformation.

In light of the launch angle, the amount of compressive deformation Cb of the golf ball 1 is preferably equal to or greater than 3.4 mm, more preferably equal to or greater than 3.5 mm, and particularly preferably equal to or greater than 3.7 mm. In light of the resilience performance, the amount of compressive deformation Cb is preferably equal to or less than 5.0 mm, and more preferably equal to or less than 4.5 mm.

In light of the launch angle, the amount of compressive deformation Cc of the core 2 is preferably equal to or greater than 4.0 mm, more preferably equal to or greater than 4.2 mm, and particularly preferably equal to or greater than 4.5 mm. In light of the resilience performance, the amount of compressive deformation Cc is preferably equal to or less than 10.0 mm, and more preferably equal to or less than 9.5 mm.

In general, the core 2 is obtained through crosslinking of a rubber composition. Illustrative examples of a base rubber for use in the rubber composition include polybutadienes, polyisoprenes, styrene-butadiene copolymers, ethylene-propylene-diene copolymers and natural rubbers. Two or more kinds of these rubbers may be used in combination. In light of the resilience performance, polybutadienes are preferred. In the case where another rubber is used in combination with a polybutadiene, to employ a polybutadiene as a predominant component is preferred. Specifically, it is preferred that a proportion of polybutadiene occupied in the entire base rubber be equal to or greater than 50% by weight, and particularly equal to or greater than 80% by weight. Polybutadienes having a percentage of cis-1, 4 bond of equal to or greater than 40%, and particularly equal to or greater than 80% are particularly preferred.

For crosslinking of the core 2, a co-crosslinking agent is usually used. Preferable co-crosslinking agent in light of the resilience performance is a monovalent or bivalent metal salt of an α,β-unsaturated carboxylic acid having 2 to 8 carbon atoms. Specific examples of the preferable co-crosslinking agent include zinc acrylate, magnesium acrylate, zinc methacrylate and magnesium methacrylate. Zinc acrylate and zinc methacrylate are particularly preferred on the grounds that a high resilience performance is achieved.

As a co-crosslinking agent, an α,β-unsaturated carboxylic acid having 2 to 8 carbon atoms, and a metal oxide may be blended. Both components react in the rubber composition to give a salt. This salt serves as a co-crosslinking agent. Examples of the preferable α,β-unsaturated carboxylic acid include acrylic acids and methacrylic acids. Examples of the preferable metal oxide include zinc oxide and magnesium oxide.

The amount of the co-crosslinking agent to be blended is preferably 5 parts by weight or greater and 30 parts by weight or less per 100 parts by weight of the base rubber. When the amount to be blended is less than the above range, the resilience performance of the golf ball 1 may become insufficient. In this respect, the amount to be blended is more preferably equal to or greater than 10 parts by weight. When the amount to be blended is beyond the above range, the launch angle of the golf ball 1 may become small. In this respect, the amount to be blended is more preferably equal to or less than 25 parts by weight, and particularly preferably equal to or less than 20 parts by weight.

In the rubber composition for use in the core 2, an organic peroxide may be preferably blended together with the co-crosslinking agent. The organic peroxide is responsible for a crosslinking reaction. By blending the organic peroxide, the resilience performance of the golf ball 1 may be improved. Examples of suitable organic peroxide include dicumyl peroxide, 1,1-bis(t-butylperoxy)-3,3,5-trimethylcyclohexane, 2,5-dimethyl-2,5-di(t-butylperoxy)hexane and di-t-butyl peroxide. Particularly versatile organic peroxide is dicumyl peroxide.

The amount of the organic peroxide to be blended is preferably 0.1 part by weight or greater and 3.0 parts by weight or less per 100 parts by weight of the base rubber. When the amount to be blended is less than the above range, the resilience performance of the golf ball 1 may become insufficient. In this respect, the amount to be blended is more preferably equal to or greater than 0.3 part by weight, and particularly preferably equal to or greater than 0.5 part by weight. When the amount to be blended is beyond the above range, the feel at impact of the golf ball 1 may become hard. In this respect, the amount to be blended is particularly preferably equal to or less than 2.5 parts by weight.

For the purpose of adjusting specific gravity, a filler may be blended to the core 2. Illustrative examples of suitable filler include zinc oxide, barium sulfate, calcium carbonate and magnesium carbonate. Powder consisting of highly dense metal may be blended as a filler. Specific examples of the highly dense metal include tungsten and molybdenum. The amount of the filler to be blended is determined ad libitum so that the intended specific gravity of the core 2 can be accomplished. Particularly preferable filler is zinc oxide. Zinc oxide serves not only as a mere agent for adjusting specific gravity but also as a crosslinking activator. Various kinds of additives such as sulfur, an anti-aging agent, a coloring agent, a plasticizer, a dispersant and the like may be blended at an appropriate amount to the core 2 as needed. Crosslinked rubber powder or synthetic resin powder may be blended to the core 2.

General diameter of the core 2 is 10 mm or greater and 41 mm or less, still more 12 mm or greater and 40 mm or less, and particularly 15 mm or greater and 40 mm or less. Crosslinking temperature of the core 2 may be 140° C. or greater and 180° C. or less, and particularly 160° C. or greater and 180° C. or less. The crosslinking time period of the core 2 is 10 minutes or longer and 60 minutes or less.

The core may be composed of a center and a mid layer covering over this center. In this instance, a similar rubber composition to the rubber composition for use in the core 2 as described above is used for the center. For the mid layer, a base rubber, a co-crosslinking agent, an organic peroxide and a filler that are similar to those for use in the aforementioned core 2 may be used. The amount of the co-crosslinking agent to be blended in the mid layer may be 15 parts by weight or greater and 40 parts by weight or less, still more 20 parts by weight or greater and 40 parts by weight or less, and particularly 20 parts by weight or greater and 35 parts by weight or less per 100 parts by weight of the base rubber. The amount of the organic peroxide to be blended in the mid layer is 0.1 part by weight or greater and 6.0 parts by weight or less, still more 0.5 part by weight or greater and 5.0 parts by weight or less, and particularly 0.5 part by weight or greater and 4.0 parts by weight or less per 100 parts by weight of the base rubber.

Illustrative examples of the base polymer for use in the cover 3 include ionomer resins, thermoplastic polyolefin elastomers, thermoplastic polyester elastomers, thermoplastic polyurethane elastomers, thermoplastic polystyrene elastomers and thermoplastic polyamide elastomers.

In the cover 3 may be blended an appropriate amount of various additives as needed. Specific examples of the additive include coloring agents such as titanium dioxide, fillers such as barium sulfate, dispersants, antioxidants, ultraviolet absorbents, light stabilizers, fluorescent agents, fluorescent brightening agents and the like. For the purpose of adjusting the specific gravity, a powder of a highly dense metal may be blended to the cover 3. Specific examples of the highly dense metal include tungsten and molybdenum.

In light of the resilience performance, Shore D hardness of the cover 3 is preferably equal to or greater than 58, and particularly preferably equal to or greater than 60. In light of the feel at impact, Shore D hardness of the cover 3 is preferably equal to or less than 68, and particularly preferably equal to or less than 65. Shore D hardness is measured in accordance with a standard of "ASTM-D 2240-68", with a Shore D type spring hardness scale. For the measurement, a slab is used which consists of the identical resin composition to that for the cover 3.

Thickness of the cover 3 is preferably 0.2 mm or greater and 2.5 mm or less. When the thickness is less than the above range, the resilience performance and durability of the golf ball 1 may become insufficient. In this respect, the thickness is more preferably equal to or greater than 0.3 mm, and particularly preferably equal to or greater than 0.5 mm. When the thickness is beyond the above range, the launch angle may become unsatisfactory. In this respect, the thickness is more preferably equal to or less than 2.0 mm, still more preferably equal to or less than 1.5 mm, and particularly preferably equal to or less than 1.0 mm. The cover 3 may be composed of two or more layers.

Figure 5:
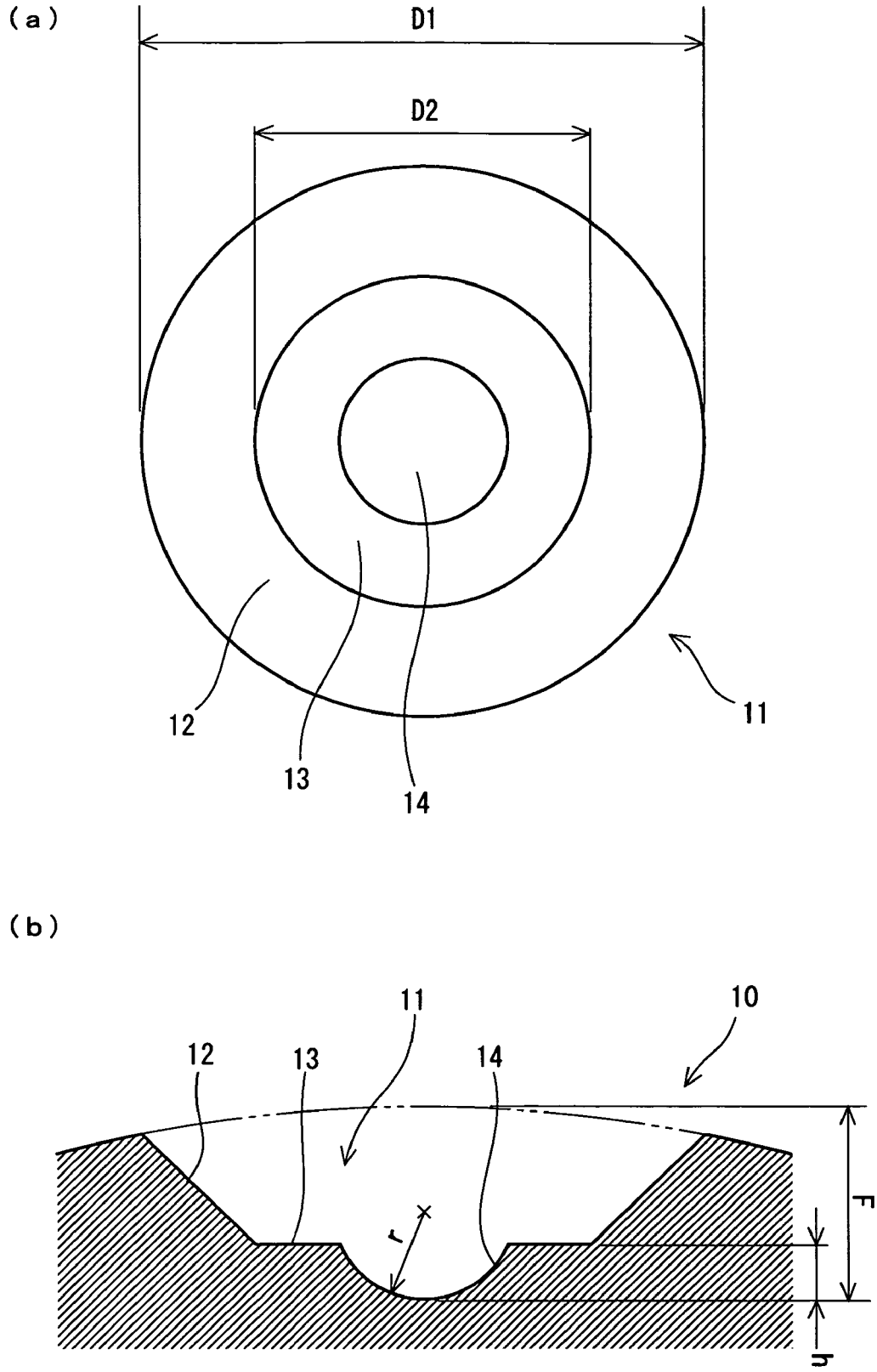
FIG. 5(*a*) is a plan view illustrating a part of a golf ball according to another embodiment of the present invention.

FIG. 5(*a*) is a plan view illustrating a part of a golf ball 10 according to another embodiment of the present invention; and FIG. 5(*b*) is a cross-sectional view of the same. In this FIG. 5(*b*), a cross-section is illustrated which is provided by a plane that passes the center of gravity of the plane shape of the dimple 11 and the center of the golf ball 10. This golf ball 10 also has a core 2 and a cover 3 which are similar to those of the golf ball 1 depicted in FIG. 1. As shown in the FIG. 5, the dimple 11 comprises an inclined face 12, a circular flat face 13 and a recessed part 14. The surface area s1 is calculated by summing up the surface area of the inclined face 12, the surface area of the circular flat face 13, and the surface area of the recessed part 14. The surface area S1 is obtained by summing up the surface areas s1 of all the dimples. As is clear from FIG. 5(*b*), the recessed part 14 is positioned at the center of the dimple 11. The cross-sectional shape of the recessed part 14 is in a circular arc. In other words, the recessed part 14 is a portion of a spherical face. The dimple may have a recessed part that is conical, truncated conical, pyramidal, truncated pyramidal, cylindrical, prismatic or the like.

What is depicted by a chain double-dashed line in FIG. 5(*b*) is a region that was cut away by the dimple 11 on the phantom spherical face. The area of this region is s2. Total area S2 is obtained by summing up the areas s2 for all the dimples.

According to this dimple 11, the surface area s1 thereof is increased on behalf of the recessed part 14. Also in this golf ball 10, the ratio (S1/S2) is equal to or greater than 1.02. This golf ball 10 is excellent in the flight performance. The ratio (S1/S2) is more preferably equal to or greater than 1.05, and particularly preferably equal to or greater than 1.08. The ratio (S1/S2) is preferably equal to or less than 1.50.

Also in this golf ball 10, total volume V is set to be 400 $mm^3$ or greater and 800 $mm^3$ or less. The total volume V is more preferably equal to or greater than 420 $mm^3$, and particularly preferably equal to or greater than 440 $mm^3$. The total volume V is more preferably equal to or less than 760 $mm^3$, and particularly preferably equal to or less than 720 $mm^3$. Through the formation of a large number of dimples 11 having the recessed part 14, the golf ball 10 can be obtained having the total volume V of within a proper range, with the ratio (S1/S2) being equal to or greater than 1.02. Also in this golf ball 10, the surface area occupation ratio Y is preferably 70% or greater and 90% or less. The surface area occupation ratio Y is more preferably equal to or greater than 72%, and particularly preferably equal to or greater than 75%. The surface area occupation ratio Y is more preferably equal to or less than 88%, and particularly preferably equal to or less than 87%. Also in this golf ball 10, the total number N of the dimples 11 is preferably 200 or greater and 500 or less. The total number N is more preferably equal to or greater than 230, and particularly preferably equal to or greater than 250. The total number N is more preferably equal to or less than 470, and particularly preferably equal to or less than 450.

Total value (Cb+Cc) of the amount of compressive deformation Cb of this golf ball 10 and the amount of compressive deformation Cc of the core is equal to or greater than 7.0 mm. The total value (Cb+Cc) is more preferably equal to or greater than 7.5 mm, and particularly preferably equal to or greater than 8.0 mm. The total value (Cb+Cc) is more preferably equal to or less than 13.0 mm, and particularly preferably equal to or less than 12.0 mm. The amount of compressive deformation Cb of the golf ball 10 is preferably equal to or greater than 3.4 mm, more preferably equal to or greater than 3.5 mm, and particularly preferably equal to or greater than 3.7 mm. The amount of compressive deformation Cb is preferably equal to or less than 5.0 mm, and more preferably equal to or less than 4.5 mm. The amount of compressive deformation Cc of the core is preferably equal to or greater than 4.0 mm, more preferably equal to or greater than 4.2 mm, and particularly preferably equal to or greater than 4.5 mm. The amount of compressive deformation Cc is preferably equal to or less than 10.0 mm, and more preferably equal to or less than 9.5 mm.

Figure 6:
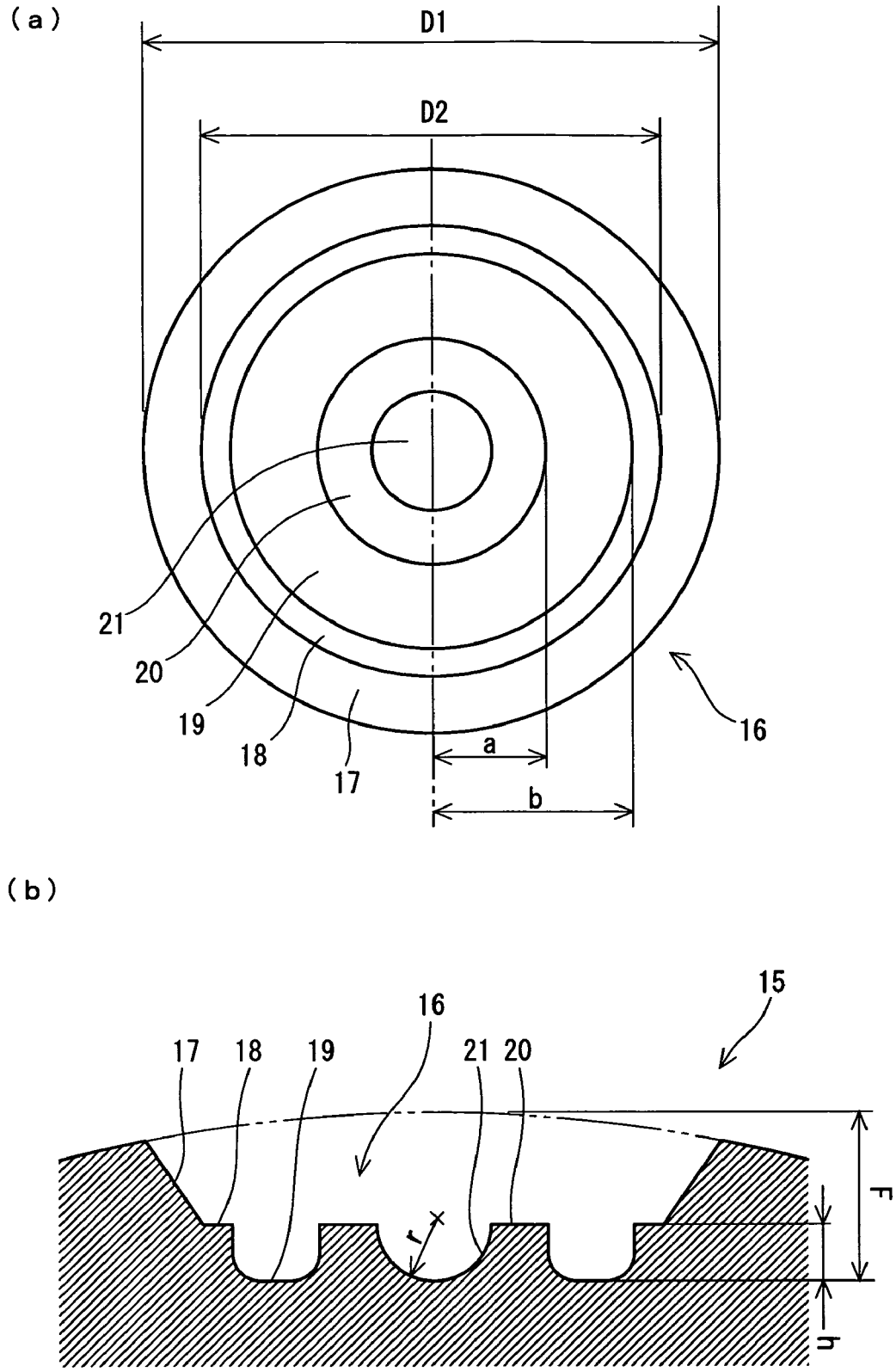
FIG. 6(*a*) is a plan view illustrating a part of a golf ball according to yet another embodiment of the present invention.

FIG. 6(*a*) is a plan view illustrating a part of a golf ball 15 according to yet another embodiment of the present invention; and FIG. 6(*b*) is a cross-sectional view of the same. In this FIG. 6(*b*), a cross-section is illustrated which is provided by a plane that passes the center of gravity of the plane shape of the dimple 16 and the center of the golf ball 15. This golf ball 15 also has a core 2 and a cover 3 which are similar to those of the golf ball 1 depicted in FIG. 1. As shown in the FIG. 6, the dimple 16 comprises an inclined face 17, a first circular flat face 18, an annular groove 19, a second circular flat face 20 and a recessed part 21. The surface area s1 is calculated by summing up the surface area of the inclined face 17, the surface area of the first circular flat face 18, the surface area of the annular groove 19, the surface area of the second circular flat face 20 and the surface area of the recessed part 21. The surface area S1 is obtained by summing up the surface areas s1 of all the dimples.

What is depicted by a chain double-dashed line in FIG. 6(*b*) is a region that was cut away by the dimple 15 on the phantom spherical face. The area of this region is s2. Total area S2 is obtained by summing up the areas s2 for all the dimples.

According to this dimple 16, the surface area s1 thereof is increased on behalf of the annular groove 19 and the recessed part 21. Also in this golf ball 15, the ratio (S1/S2) is equal to or greater than 1.02. This golf ball 15 is excellent in the flight performance. The ratio (S1/S2) is more preferably equal to or greater than 1.05, and particularly preferably equal to or greater than 1.08. The ratio (S1/S2) is preferably equal to or less than 1.50.

Also in this golf ball 15, total volume V is set to be 400 $mm^3$ or greater and 800 $mm^3$ or less. The total volume V is more preferably equal to or greater than 420 $mm^3$, and particularly preferably equal to or greater than 440 $mm^3$. The total volume V is more preferably equal to or less than 760 $mm^3$, and particularly preferably equal to or less than 720 $mm^3$. Through the formation of a large number of dimples 15 having the annular groove 19 or the recessed part 21, a golf ball can be obtained having the total volume V of within a proper range, with the ratio (S1/S2) being equal to or greater than 1.02. Also in this golf ball 15, the surface area occupation ratio Y is preferably 70% or greater and 90% or less. The surface area occupation ratio Y is more preferably equal to or greater than 72%, and particularly preferably equal to or greater than 75%. The surface area occupation ratio Y is more preferably equal to or less than 88%, and particularly preferably equal to or less than 87%. Also in this golf ball 15, the total number N of the dimples is preferably 200 or greater and 500 or less. The total number N is more preferably equal to or greater than 230, and particularly preferably equal to or greater than 250. The total number N is more preferably equal to or less than 470, and particularly preferably equal to or less than 450.

The total value (Cb+Cc) of the amount of compressive deformation Cb of this golf ball 15 and the amount of compressive deformation Cc of the core is equal to or greater than 7.0 mm. The total value (Cb+Cc) is more preferably equal to or greater than 7.5 mm, and particularly preferably equal to or greater than 8.0 mm. The total value (Cb+Cc) is more preferably equal to or less than 13.0 mm, and particularly preferably equal to or less than 12.0 mm. The amount of compressive deformation Cb of the golf ball 15 is preferably equal to or greater than 3.4 mm, more preferably equal to or greater than 3.5 mm, and particularly preferably equal to or greater than 3.7 mm. The amount of compressive deformation Cb is preferably equal to or less than 5.0 mm, and more preferably equal to or less than 4.5 mm. The amount of compressive deformation Cc of the core is preferably equal to or greater than 4.0 mm, more preferably equal to or greater than 4.2 mm, and particularly preferably equal to or greater than 4.5 mm. The amount of compressive deformation Cc is preferably equal to or less than 10.0 mm, and more preferably equal to or less than 9.5 mm.

A variety of dimples such as dimples having an annular groove (the type as illustrated in FIG. 4), dimples having a recessed part (the type as illustrated in FIG. 5), dimples having an annular groove and a recessed part (the type as illustrated in FIG. 6) and the like may be present mixed on a single golf ball. In stead of these dimples, or together with one or two or more types of these dimples, a dimple having an elevated surface area s1 on behalf of a protrusion may be formed. Examples of the shape of the protrusion include annular, spherical, conical, truncated conical, pyramidal, truncated pyramidal, cylindrical, prismatic and the like.

EXAMPLES

Example 1

A rubber composition was obtained by kneading 100 parts by weight of polybutadiene (trade name "BR-11", available from JSR Corporation), 20 parts by weight of zinc acrylate, 10 parts by weight of zinc oxide, an appropriate amount of barium sulfate and 0.8 part by weight of dicumyl peroxide. This rubber composition was placed in a mold having upper and lower half both having a hemispherical cavity, and heated at 160° C. for 25 minutes to obtain a core having the diameter of 39.5 mm.

On the other hand, 55 parts by weight of an ionomer resin (trade name "Himilan 1605", available from DU Pont-MITSUI POLYCHEMICALS Co., Ltd.), 40 parts by weight of another ionomer resin (trade name "Himilan 1706" available from DU Pont-MITSUI POLYCHEMICALS Co., Ltd.), 5 parts by weight of a thermoplastic styrene elastomer (trade name "Rabalon SR04", available from Mitsubishi Chemical Corporation) and 3 parts by weight of titanium dioxide were kneaded to give a resin composition. Shore D hardness of this resin composition was 60.

The core as described above was placed into a mold having numerous protrusions on its inside surface, and the aforementioned resin composition was injected around the core to form a cover having the thickness of 1.6 mm. On the cover were formed numerous dimples having the shape that is an inverted shape of the protrusion. Paint was applied over this cover, and thus a golf ball of Example 1 having the diameter of 42.7 mm was obtained. Specifications of this golf ball are as listed in "type II" shown in Table 1 below. All the dimples in the dimple pattern of type II have a recessed part at the center thereof.

Comparative Example 1 and Examples 2 to 3

In a similar manner to Example 1 except that specifications of the dimples were altered as presented in Table 3 below by changing the mold, golf balls of Comparative Example 1 and Examples 2 to 3 were obtained. Detailed specifications of the dimples are shown in Table 1 below. All the dimples in the dimple pattern of type I have a cross-sectional shape of a circular arc depicted in FIG. 7. All the dimples in the dimple pattern of type III have an annular groove. All the dimples in the dimple pattern of type IV have a recessed part and an annular groove.

Example 4 and Comparative Example 2

In a similar manner to Example 1 except that the type of the core was altered as presented in Table 3 below, golf balls of Example 4 and Comparative Example 2 were obtained. Details of the composition of the core are shown in Table 2 below.

Example 5 and Comparative Example 3

In a similar manner to Example 1 except that the mold and the core type were altered as presented in Table 3 below, golf balls of Example 5 and Comparative Example 3 were obtained.

TABLE 1

| Specification of Dimple | | | | | | | | | |
|---|---|---|---|---|---|---|---|---|---|
| Type | Kind | Diameter D1 (mm) | Distance D2 (mm) | Height h (mm) | Curvature r (mm) | Distance a (mm) | Distance b (mm) | Depth F (mm) | Surface area s1 ($mm^2$) |
| I | A | 4.000 | — | — | — | — | — | 0.2389 | 12.63 |
| | B | 3.450 | — | — | — | — | — | 0.2123 | 9.41 |
| | C | 3.300 | — | — | — | — | — | 0.2064 | 8.62 |
| | D | 3.150 | — | — | — | — | — | 0.1982 | 7.85 |
| II | A | 4.000 | 1.600 | 0.250 | 1.10 | — | — | 0.4439 | 12.80 |
| | B | 3.450 | 1.380 | 0.250 | 1.10 | — | — | 0.4198 | 9.58 |
| | C | 3.300 | 1.320 | 0.250 | 1.10 | — | — | 0.4139 | 8.79 |
| | D | 3.150 | 1.260 | 0.240 | 1.10 | — | — | 0.3982 | 8.01 |
| III | A | 4.000 | 2.200 | 0.075 | — | 0.700 | 1.000 | 0.2689 | 13.42 |
| | B | 3.450 | 2.000 | 0.060 | — | 0.700 | 0.975 | 0.2298 | 10.04 |
| | C | 3.300 | 2.000 | 0.050 | — | 0.700 | 0.900 | 0.2139 | 9.12 |
| | D | 3.150 | 1.800 | 0.040 | — | 0.700 | 0.900 | 0.1982 | 8.25 |
| IV | A | 4.000 | 2.200 | 0.150 | 1.10 | 0.500 | 0.750 | 0.3239 | 13.85 |
| | B | 3.450 | 2.000 | 0.142 | 1.10 | 0.500 | 0.750 | 0.2918 | 10.56 |
| | C | 3.300 | 2.000 | 0.140 | 1.10 | 0.400 | 0.700 | 0.2839 | 9.62 |
| | D | 3.150 | 1.800 | 0.140 | 1.10 | 0.400 | 0.700 | 0.2782 | 8.86 |

TABLE 1-continued

Figure 7:
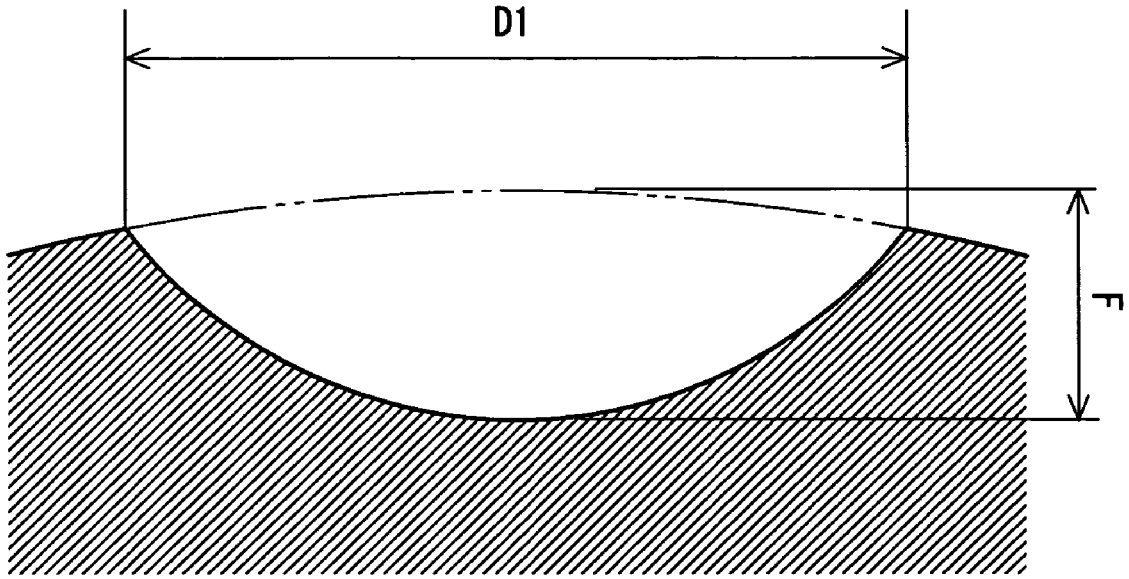
FIG. 7 is a cross-sectional view illustrating a part of a golf ball according to Comparative Examples 2 and 3.

| Specification of Dimple | | | | | | | | |
|---|---|---|---|---|---|---|---|---|
| | Area | Volume | Total area | | | Total | Occupation | Plan view |
| Type | s2 ($mm^2$) | v ($mm^3$) | S1 ($mm^2$) | S2 ($mm^2$) | S1/S2 | volume V ($mm^3$) | ratio Y (%) | Front view Enlarged view |
| I | 12.59 | 1.503 | 4349.9 | 4330.0 | 1.005 | 476.8 | 75.6 | FIG. 2 |
| | 9.36 | 0.994 | | | | | | FIG. 3 |
| | 8.57 | 0.884 | | | | | | FIG. 7 |
| | 7.80 | 0.774 | | | | | | |
| II | 12.59 | 1.443 | 4421.9 | 4330.0 | 1.021 | 476.8 | 75.6 | FIG. 2 |
| | 9.36 | 1.012 | | | | | | FIG. 3 |
| | 8.57 | 0.918 | | | | | | FIG. 5 |
| | 7.80 | 0.817 | | | | | | |
| III | 12.59 | 1.486 | 4620.9 | 4330.0 | 1.067 | 476.8 | 75.6 | FIG. 2 |
| | 9.36 | 1.010 | | | | | | FIG. 3 |
| | 8.57 | 0.886 | | | | | | FIG. 4 |
| | 7.80 | 0.760 | | | | | | |
| IV | 12.59 | 1.433 | 4838.7 | 4330.0 | 1.117 | 476.8 | 75.6 | FIG. 2 |
| | 9.36 | 1.010 | | | | | | FIG. 3 |
| | 8.57 | 0.933 | | | | | | FIG. 6 |
| | 7.80 | 0.831 | | | | | | |

TABLE 2

| Composition of core (parts by weight) | | | |
|---|---|---|---|
| Type | x | y | z |
| Polybutadiene | 100 | 100 | 100 |
| Zinc acrylate | 20 | 18 | 24 |
| Zinc oxide | 10 | 10 | 10 |
| Barium sulfate * | appropriate amount | appropriate amount | appropriate amount |
| Dicumyl peroxide | 0.8 | 0.8 | 0.8 |

* Adjusted to give the weight of the golf ball to be 45.4 g

[Travel Distance Test]

A driver with a metal head (Sumitomo Rubber Industries, Ltd., trade name "XXIO", shaft type: R, loft angle: 10°) was equipped with a swing machine manufactured by True Temper Co. Then the machine was conditioned to give the head speed of 40 m/sec, and the golf ball was hit therewith. Accordingly, travel distance (i.e., the distance from the launching point to the point where the ball stopped) was measured. Mean values of 5 times measurement are shown in Table 3 below.

As is clear from Table 3, the golf ball of each of Examples is excellent in flight performance. Therefore, advantages of the present invention are clearly indicated by these results of evaluation.

The description herein above is just for an illustrative example, therefore, various modifications can be made without departing from the principles of the present invention.

What is claimed is:

1. A golf ball which comprises a core, a cover and numerous dimples formed on the surface of the cover, wherein the ratio (S1/S2) between a summation S1 of surface areas s1 of the dimples, and a summation S2 of the areas s2 of the regions cut away by the dimples on the phantom spherical face is equal to or greater than 1.02, the total value (Cb+Cc) of the amount of compressive deformation Cb of the golf ball and the amount of compressive deformation Cc of the core is equal to or greater than 7.0 mm, and the dimples include a dimple having an annular groove.

2. The golf ball according to claim 1, wherein said amount of compressive deformation Cb is equal to or greater than 3.4 mm, and said amount of compressive deformation Cc is equal to or greater than 4.0 mm.

TABLE 3

| Results of evaluation | | | | | | | | |
|---|---|---|---|---|---|---|---|---|
| | Com. Example 1 | Example 1 | Example 2 | Example 3 | Example 4 | Com. Example 2 | Example 5 | Com. Example 3 |
| Core type | x | x | x | x | y | z | y | z |
| Amount of compressive deformation Cc (mm) | 4.5 | 4.5 | 4.5 | 4.5 | 4.9 | 3.8 | 4.9 | 3.8 |
| Amount of compressive deformation Cb (mm) | 3.5 | 3.5 | 3.5 | 3.5 | 3.8 | 3.1 | 3.8 | 3.1 |
| Cb + Cc (mm) | 8.0 | 8.0 | 8.0 | 8.0 | 8.7 | 6.9 | 8.7 | 6.9 |
| Dimple type | I | II | III | IV | II | II | IV | III |
| S1/S2 | 1.005 | 1.021 | 1.067 | 1.117 | 1.021 | 1.021 | 1.117 | 1.067 |
| Travel distance (m) | 198.0 | 201.0 | 201.5 | 202.5 | 201.5 | 200.0 | 203.0 | 199.5 |

3. The golf ball according to claim 1, wherein total volume V of said dimples is $400mm^3$ or greater and 800 $mm^3$ or less.

4. The golf ball according to claim 1, wherein said dimple having the annular groove has a recessed portion at the center of the dimple.

5. The golf ball according to claim 1, wherein the cross-sectional shape of the annular groove is u-shaped.

6. The golf ball according to claim 1, wherein the annular groove has a cross-sectional shape selected from the group consisting of v-shaped, and circular arc.

7. The golf ball according to claim 1, wherein the annular groove has a cross-sectional shape which is semi-circular.

8. The golf ball according to claim 1, wherein the ratio (S1/S2) is equal to or greater than 1.05 and the total value (Cb+Cc) is equal to or greater than 7.5 mm.

9. The golf ball according to claim 1, wherein the ratio (S1/S2) is equal to or greater than 1.08 and equal to or less than 1.50 and the total value (Cb+Cc) is equal to or greater than 8.0 mm and equal to or less than 13.0 mm.

* * * * *